US005374227A

United States Patent [19]

Webb

[11] Patent Number: 5,374,227

[45] Date of Patent: Dec. 20, 1994

[54] STAIR STEPPING EXERCISE APPARATUS

[75] Inventor: Gregory M. Webb, Independence, Va.

[73] Assignee: Nautilus Acquisition Corporation, Independence, Va.

[21] Appl. No.: 6,362

[22] Filed: Jan. 19, 1993

[51] Int. Cl.[5] ..... A63B 22/00; A63B 23/10

[52] U.S. Cl. ..... 482/52; 482/51; 482/903

[58] Field of Search ..... 482/51, 52, 53, 902, 482/903

[56] References Cited

U.S. PATENT DOCUMENTS

| | | | |
|---|---|---|---|
| 4,278,095 | 7/1981 | Lapeyre | 482/902 |
| 4,676,501 | 6/1987 | Hoagland | 482/903 |
| 4,708,338 | 11/1987 | Potts | 482/902 |
| 5,013,031 | 5/1991 | Ball | 482/52 |
| 5,051,638 | 9/1991 | Pyles | 482/902 |
| 5,290,211 | 3/1994 | Stearns | 482/70 |
| 5,299,993 | 4/1994 | Habing | 482/51 |

FOREIGN PATENT DOCUMENTS

| | | | |
|---|---|---|---|
| 2114901 | 9/1983 | United Kingdom | 482/902 |

*Primary Examiner*—Stephen R. Crow

*Attorney, Agent, or Firm*—Bell, Seltzer, Park & Gibson

[57] ABSTRACT

An apparatus permitting a user to perform a simulated stair climbing exercise includes left and right foot platforms pivotally connected to a frame by respective unequal-length four-bar linkages. The linkages maintain the foot platforms generally perpendicular to the user's lower leg during the exercise as the foot platforms are alternately depressed by the user. An eddy current brake provides the desired resistance to the user's simulated stair climbing. A display with a touch-sensitive screen is mounted on the frame and allows the user to input information to a processor which controls the resistance of the eddy current brake and other functions. The display also includes an integral television tuner that allows the user to view either a simulated image of the user performing the stair climbing exercise or a standard television program on the display during the exercise.

39 Claims, 5 Drawing Sheets 10
11
12
13
14
15
16
20
21
22
23
24
30
34
40
41
42
43
44
45
46
47
49
50
51
52
53
54
55
56
57
58
59

STAIR STEPPING EXERCISE APPARATUS

FIELD OF THE INVENTION

The invention relates to the field of exercise equipment, and more particularly, to an exercise apparatus for aerobic and strength training by permitting a user to perform a simulated stair climbing exercise.

BACKGROUND OF THE INVENTION

Exercise equipment is widely used by individuals at home and in a spa setting to obtain both strength and aerobic exercise. From free weights, strength training has now progressed to typically include the use of one or more exercise machines for greater ease of use and safety. For example, U.S. Pat. No. 3,858,873 to Jones, and assigned to the assignee of the present invention, discloses cams to provide nonlinear resistance compatible with that developed by human joints and muscles.

Aerobic classes have enjoyed widespread popularity for aerobic training of the cardiovascular system. In addition, aerobic exercise machines have also been developed, such as, for example, stationary bicycles, rowing machines, and, most recently, stair stepping machines. Stair stepping machines are particularly popular for toning the muscles of the lower body and providing an excellent aerobic workout.

A typical stair stepping exercise machine includes two foot platforms which the user alternately depresses by shifting his body weight and straightening the respective leg, thereby performing a simulated stair climbing exercise. The foot platforms are connected to a load to provide resistance to the user's stepping motion. For example, U.S. Pat. No. 3,747,924 to Champoux discloses a stair stepping machine with interconnected foot platforms so that the load on one foot platform is provided by the use's weight carried by the other foot platform. U.S. Pat. No. 4,708,338 to Potts discloses a stair stepping machine with an electrical alternator and resistor to provide the load for the user. U.S. Pat. No. 4,720,093 to Del Mar discloses a stair stepping machine having a flywheel and friction band to provide resistance. U.S. Pat. No. 4,949,993 to Stark discloses a stair stepper with independently operable foot platforms wherein the resistive load is provided by a spring. U.S. Pat. No. 5,033,733 to Findlay discloses a stair stepper with an electromagnetic brake to provide the resistance for the user's movement. Regardless of the approach to providing resistance, it is desirable that the resistance be controllable and smooth to prevent possible injury to the user.

The conventional stair steppers discussed above also each include foot platforms that remain generally horizontal throughout the user's stepping motion. This arrangement requires that the user sharply bend both the ankle and the knee joints. Unfortunately, such an arrangement is likely to create stress on the ankle joint and lower leg, and, more particularly, such an arrangement is likely to create undesirable shear forces on the knee joint.

For stair steppers, like other stationary exercise machines, it is also desirable to provide the user with feedback concerning the level of effort and performance. For example, U.S. Pat. No. 4,708,338 to Potts discloses a display of vertically oriented lights indicative of the varying level of resistance versus time for the exercise period. While such a visual display provides some feedback to the user, it does little to relieve any boredom that may result during an extended exercise period.

SUMMARY OF THE INVENTION

In view of the foregoing background, it is therefore an object of the present invention to provide a stair stepping exercise apparatus that reduces undesirable stress on the joints of the lower leg, especially the knee joint.

It is another object of the invention to provide a stair stepping exercise apparatus imparting smooth and controllable resistance to the stair stepping motion of the user during the exercise.

It is yet another object of the invention to provide a stair stepping exercise apparatus including a display of information relating to performance of the exercise, as well as entertainment, to relieve any boredom during extended exercise periods.

These and other objects, features and advantages are provided by an exercise apparatus of the present invention which includes a frame to which left and right foot platforms are connected for supporting the feet of the user while exercising, and wherein each foot platform is connected to the apparatus frame by linkage means for permitting alternating up and down movement of each foot platform as each is alternately depressed by the user and for maintaining each foot platform oriented generally perpendicular to the user's lower leg during downward movement of each foot platform. Thus, the linkage means reduces undesirable stress on the lower leg joints, particularly on the knee joint.

The foot platforms are preferably dependently coupled to each other such that one foot platform is raised as the other is depressed by the user. The dependent coupling means includes a drive belt operatively connected between the left and right foot platforms and routed over a series of pulleys carried by the frame of the apparatus.

The left and right foot platforms are attached to the frame by linkage means which is preferably provided by respective left and right. unequal-length four-bar linkages pivotally connecting the foot platforms to the frame so that each platform moves in a generally vertical and arcuate path of travel from a generally horizontal lower position to a raised position inclined from the horizontal at an angle within the range of about 20° to 25°. The unequal-length four-bar linkages maintain the respective lower legs of the user generally perpendicular to the foot platforms throughout the generally vertical and arcuate paths of travel of the foot platforms.

Resistance means is connected to the foot platforms for applying resistance thereto as the user alternately depresses each foot platform during performance of the exercise. The resistance means preferably includes an eddy current brake which provides smooth and controllable operation.

A processor is operatively connected to the eddy current brake to allow the resistance of the brake to be varied. The processor is operatively connected to a touch sensitive screen of a display mounted on the frame of the apparatus. The touch sensitive screen accepts user inputs such as the desired resistance value, the user's weight, and other parameters for the exercise session.

A foot platform sensor is mounted on the frame adjacent one of the four-bar linkages and is thereby associated with a respective foot platform to detect the number of stair stepping motions performed by the user. A second sensor is mounted adjacent the eddy current brake and senses rotation of the brake. Both sensors are operatively connected to the processor which displays on the display information such as the work level, the stepping rate, and/or a simulated value of the vertical ascent of the user. This information is valuable feedback for the user and allows the user to accurately monitor each exercise session.

An integral television tuner is preferably included with the display. This allows the user to view broadcast or cable television programs during the exercise session, such as to reduce boredom during the exercise session.

FIGS. *6a–6c* are enlarged side elevational views of the foot platforms and unequal-length four-bar linkages of the present invention at different positions during operation by the user.

Figure 7:
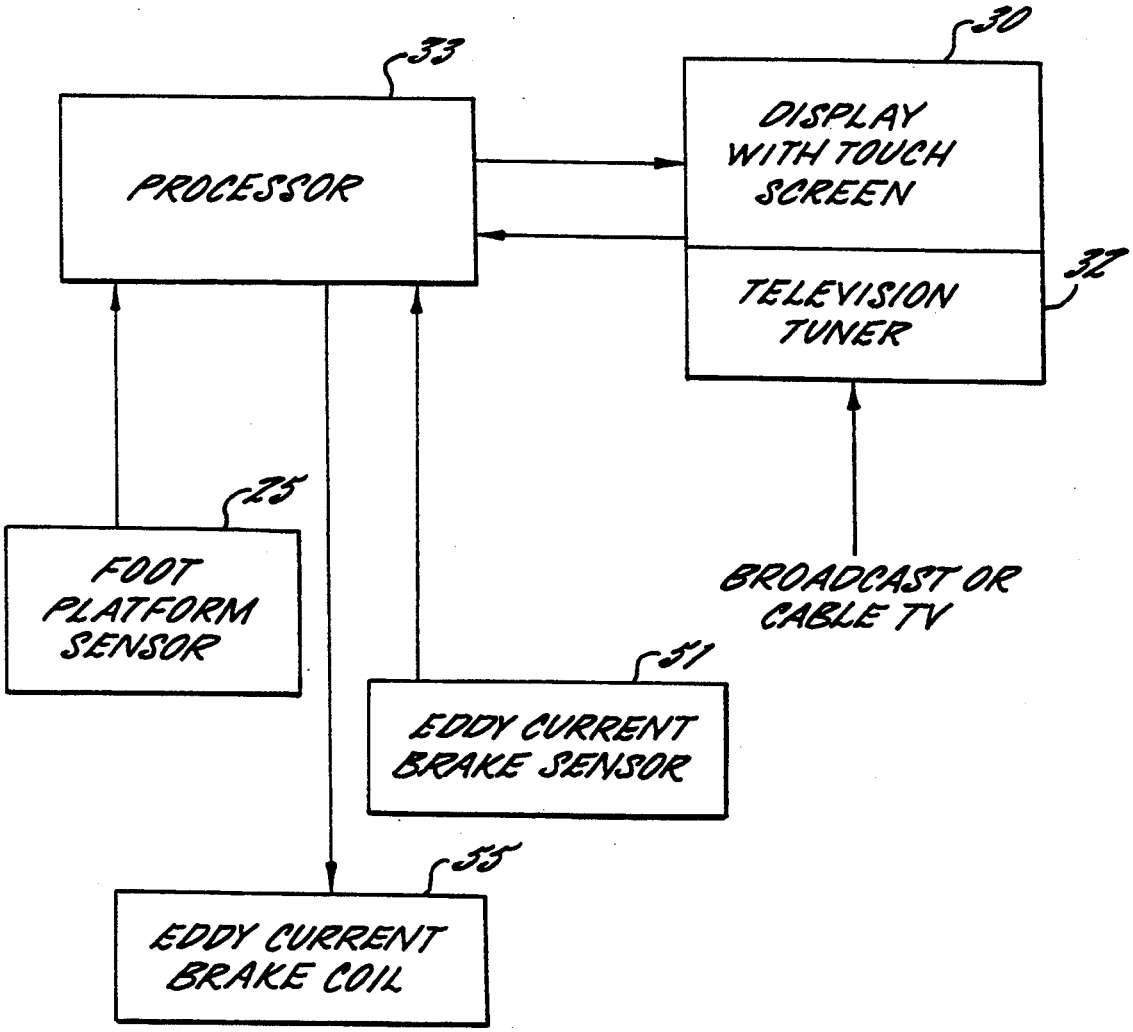

FIG. 7 is a schematic block diagram of the processor and associated components of the present invention.

DETAILED DESCRIPTION OF THE PREFERRED EMBODIMENTS

The present invention will now be described more fully hereinafter with reference to the accompanying drawings, in which a preferred embodiment of the invention is shown. This invention may, however, be embodied in many different forms and should not be construed as limited to the embodiment set forth herein. Applicants provide this embodiment so that this disclosure will be thorough and complete, and will fully convey the scope of the invention to those skilled in the art. Like numbers refer to like elements throughout.

Figure 1:
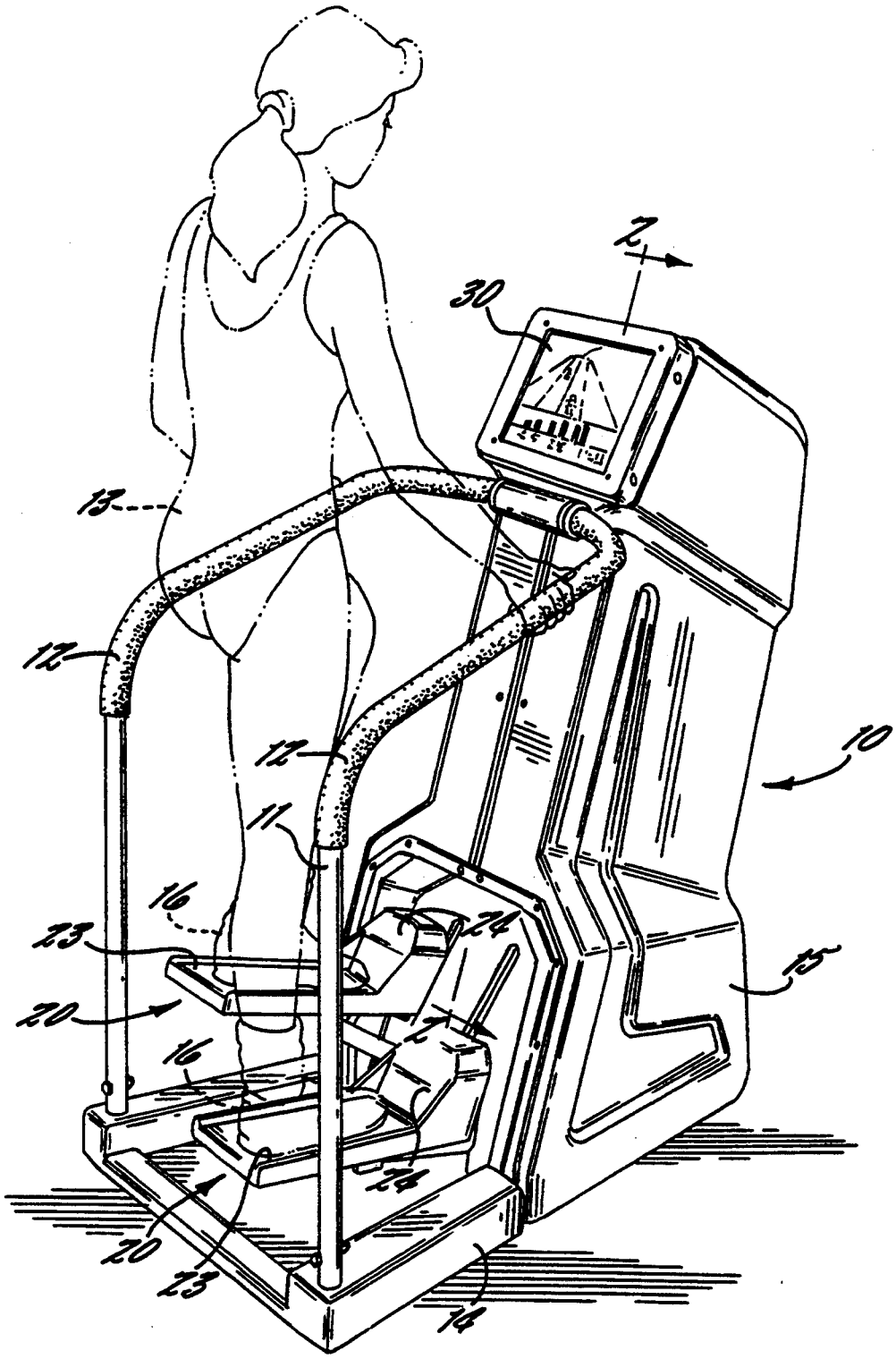
FIG. 1 is a perspective view of the stair stepping exercise apparatus according to the present invention.
Figure 2:
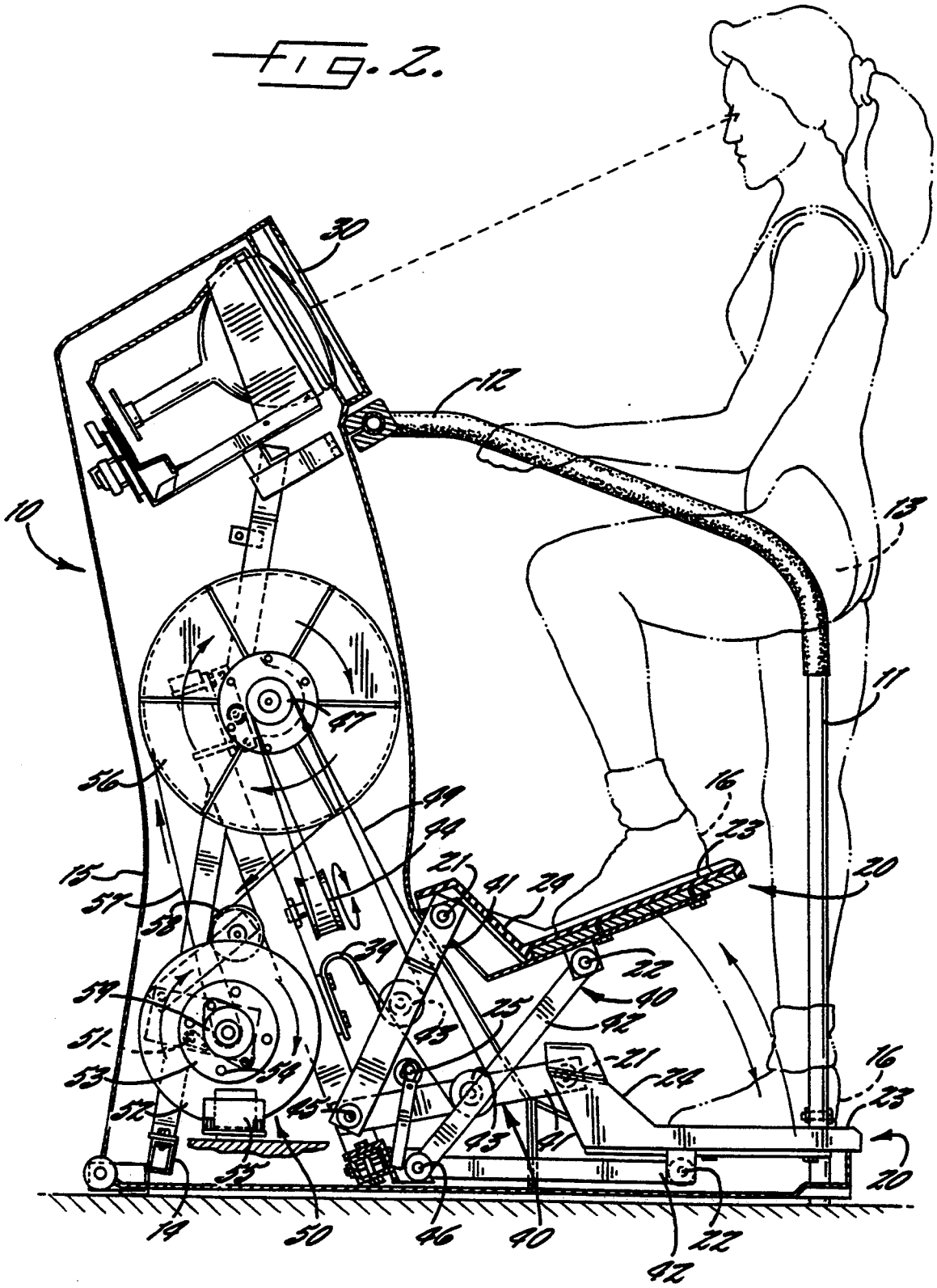
FIG. 2 is a side elevational view of the stair stepping exercise apparatus shown in FIG. 1 looking in the direction of arrow 2.

The stair stepping apparatus of the present invention is generally designated as 10 in the accompanying drawings. Referring first to FIGS. 1 and 2, the stair stepping apparatus 10 includes a frame 14 supporting a pair of hand rails 11, which in turn are fitted with hand grips 12 for grasping by the user 13 to assist the user in maintaining balance while performing the simulated stair climbing exercise. A housing 15 is mounted on the frame 14 to enclose a display 30 and other components as more fully described below. As illustrated, the display 30 is mounted to the top of the frame 14 and is positioned so that it can be viewed by the user 13 while exercising.

Left and right foot platforms 20 support the respective feet 16 of the user 13 while exercising. Each foot platform 20 has a base portion 23 and a toe portion 24 extending outwardly therefrom to ensure that the feet 16 of the user 13 are properly positioned during the exercise and are fully supported when the foot platforms 20 are in the raised position.

As best understood by reference to FIG. 2, each foot platform 20 is pivotally connected to the frame 14 by an unequal-length four-bar linkage 40 that provides the linkage means for connecting each foot platform to the frame. Each four-bar linkage 40 includes an upper connecting bar 41 and a lower connecting bar 42. The upper connecting bar 41 is pivotally connected to the foot platform 20 by an upper foot platform pivot pin 21 and to the frame 14 by an upper frame pivot pin 45. The lower connecting bar 42 is pivotally connected to the foot platform 20 by a lower foot platform pivot pin 22 and to the frame 14 by a lower frame pivot pin 46. The upper connecting bar 41 and the lower connecting bar 42 are unequal in length as are the distances between the upper frame pivot pin 45 and lower frame pivot pin 46, and upper foot platform pivot pin 21 and lower foot platform pivot pin 22, thus defining the unequal-length four-bar linkage 40.

As shown in FIGS. *6a–6c*, the unequal-length four-bar linkages 40 connect each foot platform 20 to the frame 14 for permitting alternating up and down movement of each foot platform as each foot platform is alternately depressed by the user 13. The four-bar linkages 40 also serve to maintain each foot platform oriented generally perpendicular to the user's lower leg during the downward movement of each foot platform to thereby reduce undesirable stress on the user's lower leg joints, particularly to reduce undesirable shear forces on the knee joint. The unequal-length four-bar linkages 40 pivotally connect respective left and right foot platforms 20 to the frame 14 so that each platform moves in an arcuate path of travel between a generally horizontal lower position and a raised position wherein each platform is inclined at an angle in the range of about 20° to 25° from the horizontal. More preferably this angle is about 22°. Thus, the unequal-length four-bar linkages 40 maintain the lower legs of the user oriented generally perpendicular to the foot platforms 20 during the alternating up and down full arcuate path of travel of the foot platforms.

Referring more particularly to FIGS. *6b* and *6c*, the operation of the linkage means, such as the unequal-length four-bar linkage, is further explained. The linkage means defines a moving axis of rotation or moving instantaneous center for each foot platform 20 as indicated by points A and B in FIG. *6b*. The moving axis of rotation at points A, B is defined by intersecting imaginary lines 41A, 42A and 41B, 42B, respectively. Moreover, as shown in FIG. *6c* the relationship between each foot platform 20 and the linkage means is further illustrated by the imaginary line 20' intersecting the pivot points 21, 22 at the horizontal and raised positions, and wherein a constant angle $\alpha$ is maintained between the imaginary line 20' and the foot platform 20. Accordingly, each foot platform 20 follows a predetermined path defined by the changing axis of rotation so as to maintain the fool platform 20 oriented generally perpendicular to the user's lower leg during movement of the foot platform.

Figure 3:
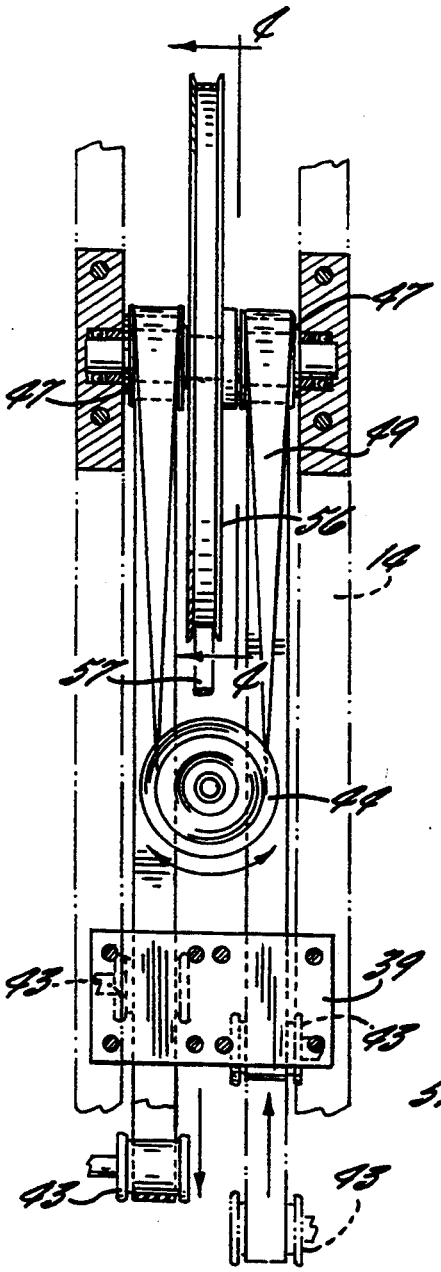
FIG. 3 is a greatly enlarged elevational view of the belt and pulley dependent coupling means of the present invention.
Figure 4:
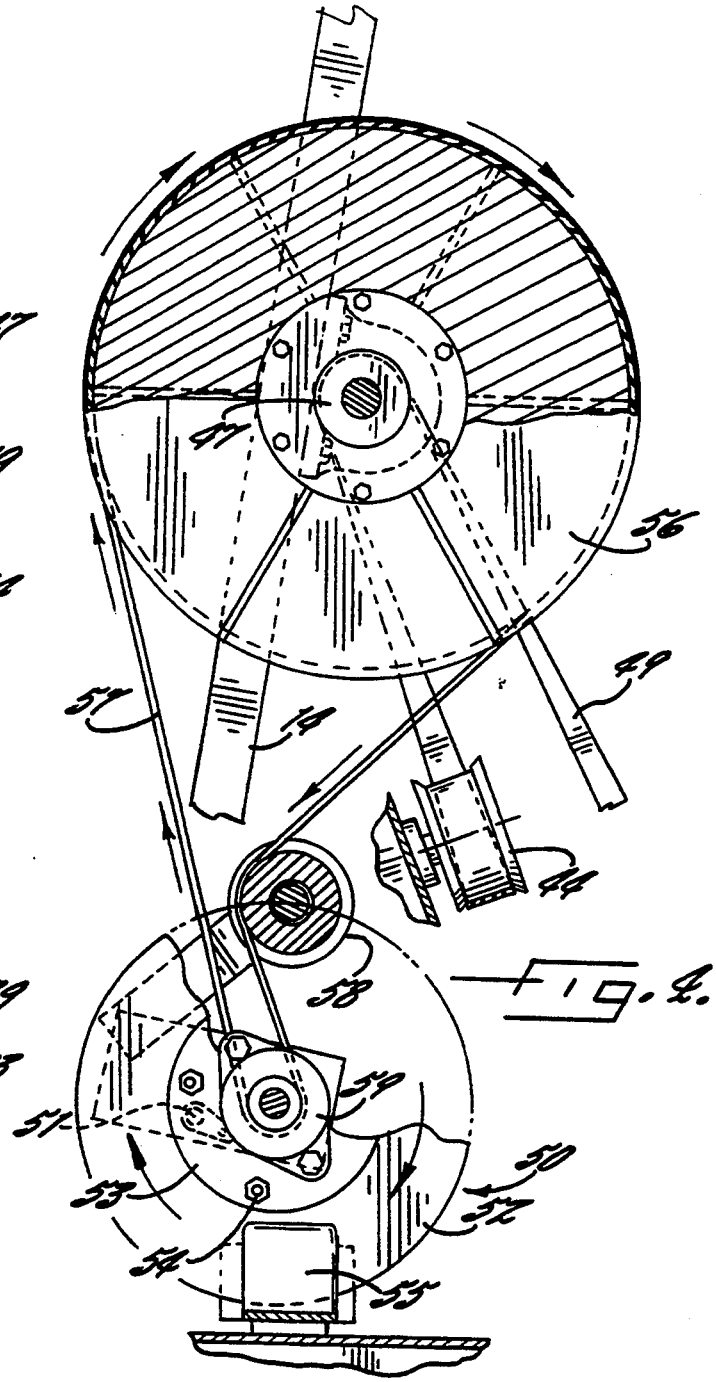
FIG. 4 is a greatly enlarged side elevational view, partially in section, of the eddy current brake and drive wheel of the present invention.

Referring now additionally to FIGS. 3 and 4, the apparatus 10 includes a flexible toothed coupling belt 49 dependently coupling the four-bar linkages 40 together as illustrated. The ends of the coupling belt 49 are fixedly secured to the frame 14 by a coupling belt anchor 39. The end portions of the coupling belt 49 are directed over pulleys 43 mounted to the upper connecting bar 41 of respective four-bar linkages 40. From the linkage pulleys 43, the coupling belt 49 is directed over drive wheel pulleys 47 and is turned 90° so that the center portion of the belt reciprocates over a central pulley 44.

Each drive wheel pulley 47 is connected to the drive wheel 56 by a one-way clutch, which allows the pulley 47 to freewheel in an unclutched rotational direction and engage in the opposite direction. For example, when the left foot platform 20 is depressed by the user 13, the right-hand drive pulley 47 freewheels and the left-hand pulley 47 engages and rotates the drive wheel 56 in the clockwise direction when viewed from the left hand side of the apparatus 10.

The drive wheel 56 drives an eddy current brake 50 that provides the desired resistance for the user 13. An eddy current brake drive belt 57 couples the drive wheel 56 and the brake 50 and is tensioned by an idler pulley 58. The ratio of the diameter of the relatively large drive wheel 56 to the relatively small hub 59 of the eddy current brake 50 causes high rotational speed for the eddy current brake 50 to thereby increase the smoothness of operation of the apparatus 10. A flywheel 53 is also connected to the hub 59 of the eddy current brake 50 to further enhance the smoothness of operation of the apparatus.

Figure 5:
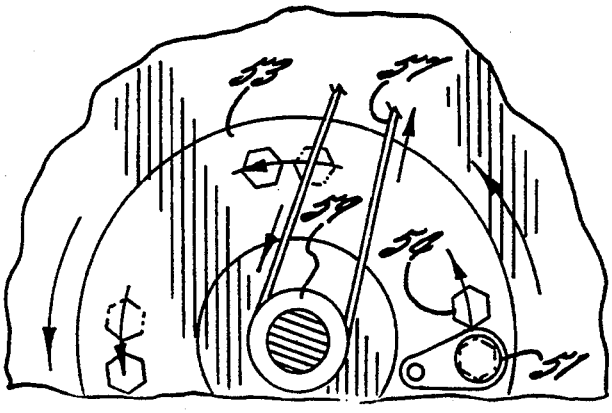
FIG. 5 is a greatly enlarged side elevational view of a portion of the eddy current brake disc hub of the present invention.
Figures 6A, 6B, 6C:
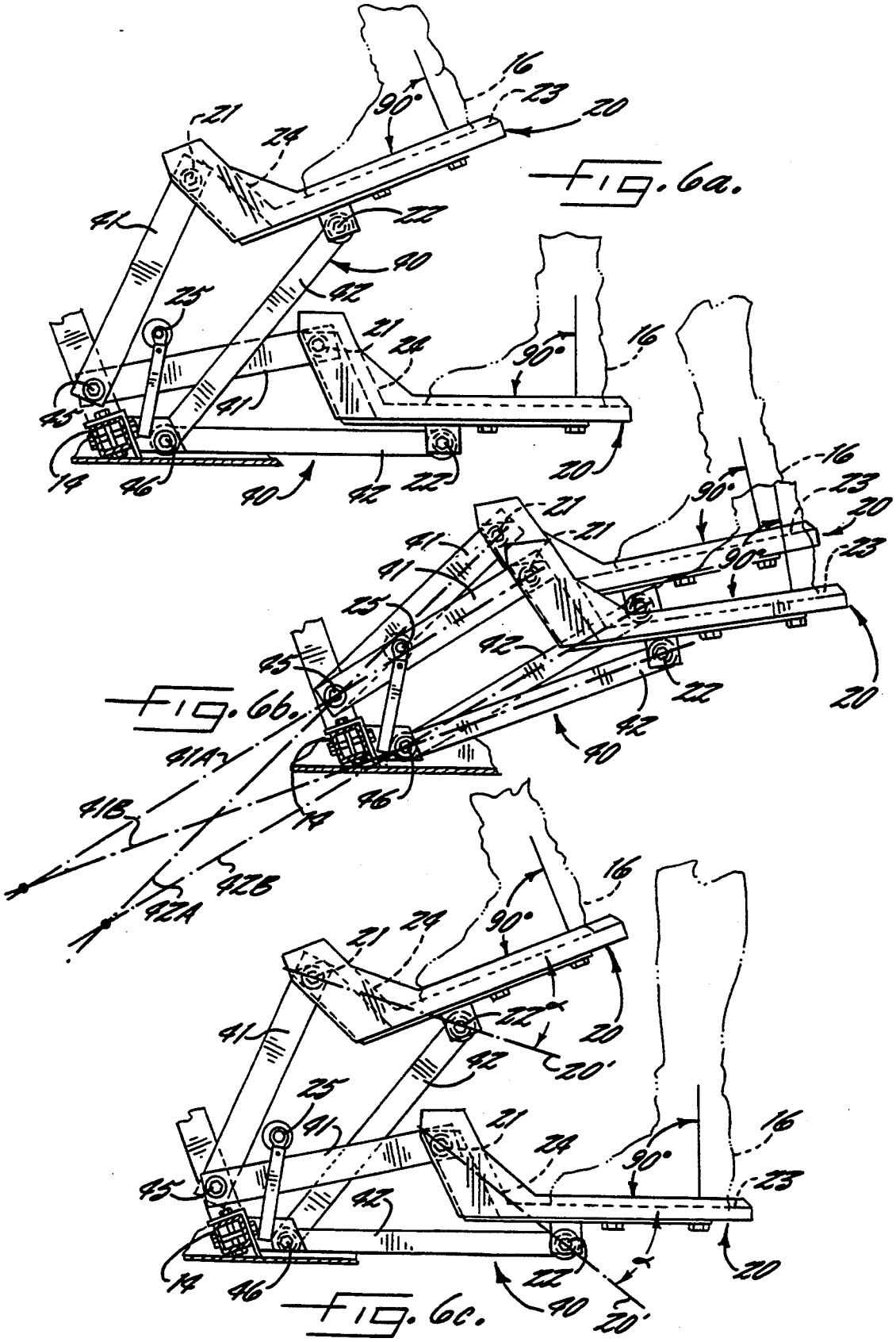

The eddy current brake 50 includes an eddy current brake disc 52 and an eddy current brake coil 55 mounted on the frame 14 so that the poles of the coil are in closely spaced apart relation to the rotating brake disc 52. The eddy current brake 50 imparts a smooth, steady and controllable braking force. An eddy current brake sensor 51 is mounted on the frame 14 adjacent the disc hub 53 and senses rotation of the disc by detecting the passage adjacent thereto of the hub bolts 54 as shown in FIG. 5.

Referring now to FIG. 7, the processor 33, display 30 and other associated components are explained. The processor 33 is operatively connected to the foot platform sensor 25 and the eddy current brake sensor 51 so that the processor can determine the stepping rate of the user 13 and the rotation rate of the eddy current brake disc 52. This and other information may then be displayed on the display 30. The display 30 preferably includes a touch sensitive screen for accepting one or more user inputs. The work level, the stepping rate, and/or a simulated value of the vertical ascent of the user 13 may thus be readily calculated by the processor 33 and displayed on the display 30. As would be readily understood by those skilled in the art, the simulated vertical ascent of the user may be based upon the user's weight, entered as a user input via the touch sensitive screen of the display, and the work level of the user based upon the eddy current brake sensor 51.

The processor 33, cooperating with the touch sensitive screen, permits the user to select the amount of resistance to be provided by the eddy current brake 50, for example, by changing the width of electrical pulses delivered to the eddy current brake coil 55. The processor 33 may also include memory means for storing preprogrammed exercise routines which vary the resistance versus time as would be readily understood by those skilled in the art.

The display 30 preferably includes an integral television tuner 32 which allows the user 13 to view commercial television programs from commercial broadcast sources or via a cable television connection. The user 13 can also control the television tuner 32 via the touch sensitive screen and may select between a television program or a simulated exercise image.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. An apparatus permitting a user to perform a simulated stair climbing exercise, said apparatus comprising:

a frame;

left and right foot platforms for supporting respective feet of the user;

unequal-length four-bar linkage means connecting each foot platform to said frame for permitting alternating up and down movement of each foot platform along a predetermined path of travel so that each foot platform moves between a generally horizontal lower position and a raised position wherein the platform is inclined at a predetermined angle from the horizontal as each foot platform is alternately depressed by the user so as to maintain each foot platform oriented generally perpendicular to the user's lower leg during downward movement of each foot platform; and resistance means operatively connected to said left and right foot platforms for applying resistance thereto as the user alternately depresses each foot platform during performance of the simulated stair climbing exercise.

2. An apparatus according to claim 1 wherein said resistance means comprises dependent coupling means for dependently coupling said left and right foot platforms together so that one of said foot platforms is raised as the other of said foot platforms is depressed by the user.

3. An apparatus according to claim 2 wherein said dependent coupling means comprises a drive belt operatively connecting said left and right foot platforms, and one or more pulleys carried by said frame and supporting said drive belt.

4. An apparatus according to claim 1 wherein said unequal-length four-bar linkage means comprises left and right unequal-length four-bar linkages pivotally connecting respective left and right foot platforms to said frame so that each platform moves in a generally arcuate path of travel between a generally horizontal lower position and a raised position wherein each platform is inclined at an angle in the range of about 20° to 25° from the horizontal.

5. An apparatus according to claim 1 wherein said resistance means comprises an eddy current brake.

6. An apparatus according to claim 1 further comprising a processor operatively connected to said resistance means for controlling the resistance of same responsive to a user-selected resistance value.

7. An apparatus according to claim 6 further comprising a display carried by said frame and operatively connected to said processor, and wherein said processor includes means for displaying on said display the user-selected resistance value.

8. An apparatus according to claim 7 wherein said display further comprises a touch sensitive screen operatively connected to said processor, and wherein said processor further includes means for accepting a user input from said touch sensitive screen.

9. An apparatus according to claim 7 further comprising a sensor associated with said resistance means, and wherein said processor further includes means operatively connected to said sensor for generating and displaying on said display a work level of the user during performance of the exercise.

10. An apparatus according to claim 9 wherein said processor further includes means for determining and displaying on said display a simulated value of the vertical ascent of the user based upon the user's weight and the work level of the user during performance of the exercise.

11. An apparatus according to claim 7 further comprising a foot platform sensor carried by said frame and associated with one of said foot platforms for sensing movement thereof, and wherein said processor further includes means operatively connected to said foot platform sensor for generating and displaying on said display a stepping rate of the user during performance of the exercise.

12. An apparatus according to claim 7 wherein said display further comprises an integral television tuner for permitting the user to select one of a simulated image generated by said processor and a television program image.

13. An apparatus according to claim 1 further comprising a pair of spaced apart handles carried by said frame for grasping by the user.

14. An apparatus according to claim 1 wherein said left and right foot platforms each includes a generally flat base portion and a toe portion extending outwardly from said base portion.

15. An apparatus permitting a user to perform a simulated stair climbing exercise, said apparatus comprising:

a frame;

left and right foot platforms for supporting respective feet of the user;

unequal-length four-bar linkage means connecting each foot platform to said frame for permitting alternating up and down movement of each foot platform along a predetermined path of travel so that each foot platform moves between a generally horizontal lower position and a raised position wherein the platform is inclined at a predetermined angle from the horizontal as each foot platform is alternately depressed by the user and so as to maintain each foot platform oriented generally perpendicular to the user's lower leg during downward movement of each foot platform;

an eddy current brake operatively connected to said left and right foot platforms for applying resistance thereto as the user alternately depresses each foot platform during performance of the simulated stair climbing exercise; and a processor operatively connected to said eddy current brake for controlling same responsive to a user selected resistance value.

16. An apparatus according to claim 15 further comprising a display carried by said frame and operatively connected to said processor, and wherein said processor includes means for displaying on said display the user-selected resistance value.

17. An apparatus according to claim 16 wherein said display further comprises a touch sensitive screen operatively connected to said processor, and wherein said processor further includes means for accepting a user input from said touch sensitive screen.

18. An apparatus according to claim 16 further comprising a sensor associated with said resistance means, and wherein said processor further includes means operatively connected to said sensor for generating and displaying on said display a work level of the user during performance of the exercise.

19. An apparatus according to claim 18 wherein said processor further includes means for determining and displaying on said display a simulated value of the vertical ascent of the user based upon the user's weight and the work level of the user during performance of the exercise.

20. An apparatus according to claim 16 further comprising a foot platform sensor carried by said frame and associated with one of said foot platforms for sensing movement thereof, and wherein said processor further includes means operatively connected to said foot platform sensor for generating and displaying on said display a stepping rate of the user during performance of the exercise.

21. An apparatus according to claim 16 wherein said display further comprises an integral television tuner for permitting the user to select one of a simulated image generated by said processor and a television program image.

22. An apparatus according to claim 15 further comprising dependent coupling means for dependently coupling said left and right foot platforms together so that one of said foot platforms is raised as the other of said foot platforms is depressed by the user.

23. An apparatus according to claim 22 wherein said dependent coupling means comprises a drive belt operatively connecting said left and right foot platforms, and one or more pulleys carried by said frame and supporting said drive belt.

24. An apparatus according to claim 15 wherein said unequal-length four-bar linkage means comprises left and right unequal-length four-bar linkages pivotally connecting respective left and right foot platforms to said frame so that each platform moves in a generally arcuate path of travel between a generally horizontal lower position and a raised position wherein each platform is inclined at an angle in the range of about 20° to 25° from the horizontal.

25. An apparatus according to claim 15 further comprising a pair of spaced apart handles carried by said frame for grasping by the user.

26. An apparatus according to claim 15 wherein said left and right foot platforms each includes a generally flat base portion and a toe portion extending outwardly from said base portion.

27. An apparatus permitting a user to perform a simulated stair climbing exercise, said apparatus comprising:

a frame;

left and right foot platforms for supporting respective feet of the user;

left and right unequal-length four-bar linkages pivotally connecting respective foot platforms to said frame for permitting alternating up and down movement of each foot platform along a generally arcuate path of travel so that each foot platform moves between a generally horizontal lower position and a raised position wherein each platform is inclined at a predetermined angle from the horizontal as each foot platform is alternately depressed by the user so as to maintain each foot platform oriented generally perpendicular to the user's lower leg during downward movement of each foot platform;

resistance means operatively connected to said left and right foot platforms for applying resistance thereto as the user alternately depresses each foot platform during performance of the simulated stair climbing exercise;

a processor operatively connected to said resistance means for controlling same responsive to a user selected resistance value; and a display carried by said frame and operatively connected to said processor, said processor including means for displaying on said display the user selected resistance value.

28. An apparatus according to claim 27 wherein said predetermined angle of each of said foot platforms in the raised position is in the range of about 20° to 25°.

29. An apparatus according to claim 27 wherein said display further comprises a touch sensitive screen operatively connected to said processor, and wherein said processor further includes means for accepting a user input from said touch sensitive-screen.

30. An apparatus according to claim 27 further comprising a sensor associated with said resistance means, and wherein said processor further includes means operatively connected to said sensor for generating and displaying on said display a work level of the user during performance of the exercise.

31. An apparatus according to claim 30 wherein said processor further includes means for determining and displaying on said display a simulated value of the vertical ascent of the user based upon the user's weight and the work level of the user during performance of the exercise.

32. An apparatus according to claim 27 further comprising a foot platform sensor carried by said frame and associated with one of said foot platforms for sensing movement thereof, and wherein said processor further includes means operatively connected to said foot platform sensor for generating and displaying on said display a stepping rate of the user during performance of the exercise.

33. An apparatus according to claim 27 wherein said display further comprises an integral television tuner for permitting the user to select one of a simulated image generated by said processor and a television program image.

34. An apparatus permitting a user to perform a simulated stair climbing exercise, said apparatus comprising:

a frame;

left and right foot platforms for supporting respective feet of the user;

linkage means connecting each foot platform to a fixed pivot point on a lower portion of said frame for permitting alternating up and down movement of each foot platform along a predetermined path of travel defined by a changing axis of rotation so that each foot platform moves between a generally horizontal lower position and a raised position wherein the platform is inclined at a predetermined angle from the horizontal as each foot platform is alternately depressed by the user so as to maintain each foot platform oriented generally perpendicular to the user's lower leg during downward movement of each foot platform; and resistance means operatively connected to said left and right foot platforms for applying resistance thereto as the user alternately depresses each foot platform during performance of the simulated stair climbing exercise.

35. An apparatus according to claim 34 wherein said resistance means comprises dependent coupling means for dependently coupling said left and right foot platforms together so that one of said foot platforms is raised as the other of said foot platforms is depressed by the user.

36. An apparatus according to claim 34 wherein said linkage means comprises left and right unequal-length four-bar linkages pivotally connecting respective left and right foot platforms to said frame so that each platform moves in a generally arcuate path of travel between a generally horizontal lower position.

37. An apparatus according to claim 34 wherein said resistance means comprises an eddy current brake.

38. An apparatus according to claim 34 further comprising a processor operatively connected to said resistance means for controlling the resistance of same responsive to a user-selected resistance value.

39. An apparatus according to claim 34 wherein said left and right foot platforms each includes a generally flat base portion and a toe portion extending outwardly from said base portion.

* * * * *